US005379016A

United States Patent [19]

Smith et al.

[11] Patent Number: 5,379,016

[45] Date of Patent: Jan. 3, 1995

[54] CHIP RESISTOR

[75] Inventors: Jerome D. Smith, Yokohama; Keiichiro Hayakawa, Kanagawa; Yasuo Yamamoto, Tokyo, all of Japan

[73] Assignee: E. I. Du Pont de Nemours and Company, Wilmington, Del.

[21] Appl. No.: 71,625

[22] Filed: Jun. 3, 1993

[51] Int. Cl.[6] ..... H01C 1/012; H01C 1/148

[52] U.S. Cl. ..... 338/308; 338/195; 338/332; 338/292; 338/293

[58] Field of Search ..... 338/308, 306, 307, 314, 338/195, 332, 292, 293

[56] References Cited

U.S. PATENT DOCUMENTS 4,684,916 8/1987 Ozawa ..... 338/308

5,258,738 11/1993 Schat ..... 338/332

FOREIGN PATENT DOCUMENTS 51-129677 11/1976 Japan ..... H05K 3/00

*Primary Examiner*—Marvin M. Lateef

[57] ABSTRACT

To provide a chip resistor with small variation of ESD required when in automobile use, a chip resistor containing (1) insulating substrate, (2) a pair of terminations disposed over said substrate, (3) resistor layer of thick film resistor composition comprising a mixture of finely divided of conductive component and glass binder, wherein said resistor layer being disposed and patterned on the surface of said substrate by printing and firing to form continuous conductive path comprising divided sections connecting to each of said termination, and divided section angled in its longitudinal direction from the direction of current flow in said respective 4 sections connected to said terminations being insulated and separated from one another by underlaying substrata resulting into considerably longer resistor geometry than distance between said terminations.

3 Claims, 4 Drawing Sheets

CHIP RESISTOR

FIELD OF INVENTION

The invention relates to a chip resistor having a thick film resistor produced by printing and firing a thick film composition containing conductive component on a conductor pattern or electrodes formed on the surface of an insulating substrate.

BACKGROUND OF THE INVENTION

It is important for such resistors to exhibit high electrical stability, particularly with small variation in Electrostatic Discharge (ESD). It is particular important when the resistors are used to protect electronic circuits form ignition pulses in automotive use, namely, as constituents of engine control units for automobiles. As sizes of chip resistors have become smaller in recent years, the length of the thick film resistors formed upon them has also decreased. The resistors length rather than the width is recognized as contributing strongly to the stability of variation of ESD. It is clear that reduction of voltage gradient (V/mm) is possible as the resistor's length is made longer and this reduction in gradient results in less variation of ESD.

A thick film resistor composition containing glass binder, vehicle of resin materials with solvents and conductive material is screen printed on a substrate so as to be terminated with conductor pads formed on the substrate by the preceding screen printing process and the resistor overlaps the conductor pad.

Immediately after screening the solvents are removed by air drying or low temperature heat-assisted drying, and resistors are produced by firing the screened paste on a substrate. Resistor geometries and dimensions shall be determined by using the aspect ratio of the resistor as the ratio of the resistor's length to width, and they are also based on required stability, power density, and/or voltage stress. The resistor value can be adjusted to reach the desired target resistor value by laser trimming. Kerf cuts (trim cut) are made by removing spots of resistive materials by pulsing a laser repetitively to produce a series of small additive resistance changes until a target resistance is achieved.

A considerably high voltage, e.g., 10–20 Kv, as in a spark, may be applied to the circuit of the ignition equipment of an automobile. ESD serves as an indicator of voltage endurance of the resistor against this high voltage. This parameter is represented as % change in the value of resistance before and after the application of a static electricity of a certain voltage. In recent years, there has been a demand for less variation of ESD not only at 5 Kv, but also at 2.5 Kv. Kerf cuts by laser trimming are useful for adjustments of the resistance values of resistor with desired geometries or aspect ratios obtained by screen printing, but they are not satisfactory in terms of the negative effect on ESD stability when laser trimming is performed without any consideration of the matching of resistor geometries with trim configuration.

SUMMARY OF THE INVENTION

The present invention is directed to a chip resistor with the stability and small variation in ESD, having the resistor geometrics allowing the greater ratio of the resistor's length to width, and trim configuration keeping the resistor's width even after the trimming process.

In particular, the invention is directed to a chip resistor comprising:

(1) insulating substrate, (2) a pair of terminations disposed over said substrate, and (3) resistor layer of thick film composition comprising a mixture a mixture of finely divided of conductive component and glass binder wherein said resistor layer being disposed and patterned on the surface of said substrate by printing and firing to form continuous conductive resistance path comprising divided sections connecting to each of said termination, and divided section angled in its longitudinal direction from the direction of current flow in said respective sections connected to said terminations being insulated and separated from one another by underlying substrate resulting into considerable longer resistor geometry than distance between said terminations.

In a second aspect, the invention is directed to the chip resistor of which resistance is adjusted upward by laser trimming one or more said sections using a trimming geometry along the longitudinal direction of said angled sections which results into longer conductive resistance path without reducing the width of the untrimmed portion in the perpendicular direction to said longitudinal direction.

BRIEF DESCRIPTION OF THE DRAWING

The advantages and features of the present invention will readily be appreciated by persons skilled in the art from the following detailed description when read in conjunction with the drawing wherein.

DETAILED DESCRIPTION OF THE INVENTION

In General

Figure 1:
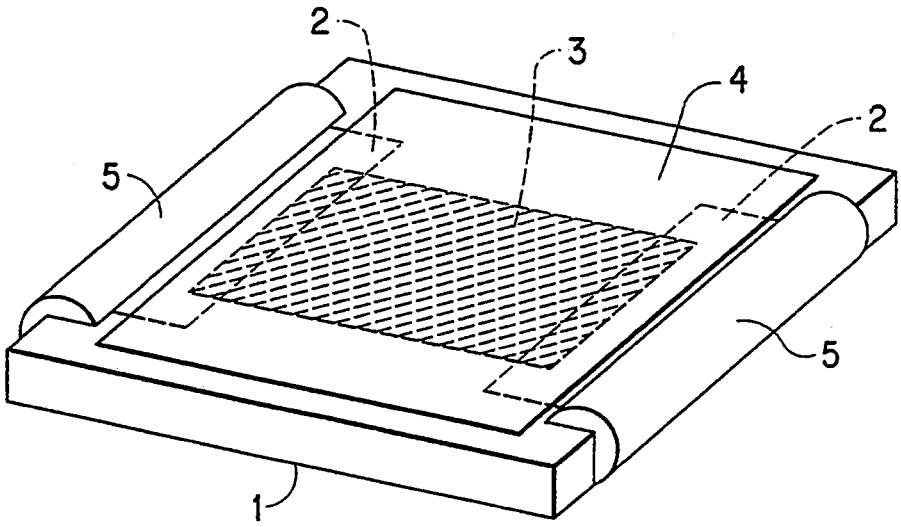
FIG. 1 is a schematic illustration of chip resistor structure.
Figure 2:
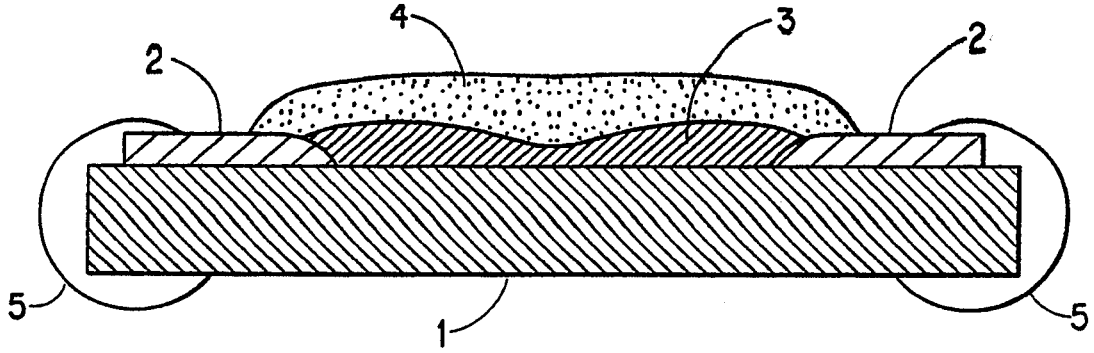
FIG. 2 schematically illustrates a cross-section of the chip resistor showing the correlation of substrate, internal and external termination/electrode and coat covering glass.

In the following detailed description and in the several figures of the drawings, like elements are identified with like reference numerals.

Referring now to FIG. 1, first thick film conductor paste (pads) 2 is applied by screen printing onto an alumina substrate 1. Upon completion of drying the paste, the pads 2 are fired at 800° C.~950° C. in a conveyor belt kiln in air which have several zones of controllable heat, which permit a temperature versus time profile to be set up for a particular material. A thick film resistor composition paste 3 is then printed over the fired conductor pads 2 so as to overlap the conductor pad 2 at its edge and be terminated with such conductors 2. After drying, the thick film resistor 3 (and conductors 2, if not previously fired) are fired in the same way.

In addition, as is known in the art, to protect a fired thick film resistor layer 3, a crystalline low melting glass 4 such as a PbO-B203 type amorphous low crystallinity glass is screen printed as an encapsulant onto the alumina substrate containing the fired conductor pads 2 and the overlying fired resistor 3. When thick film resistor 3 is trimmed, the laser penetrates the overcoat glass layer 4 and causes vaporization and removal of glass 4 and resistor 3 material along the formed laser kerf for adjustment of the resistor value. External electrodes 5 can be formed by screen printing and firing around the edges of substrate, and are connected to the fired conductor pads 2 onto the substrate 1. These external electrodes 5 are plated with nickel, a barrier layer to inhibit unwanted destruction of the screen printed/fired electrode bonded to the substrate in sequential soldering.

Thick Film Resistor Composition

The thick film resistor composition suitable for use in the invention contains as an electrically conducting component a ruthenium oxide or a ruthenium pyrochlore oxide, the preferred ruthenium pyrochlore oxides are bismuth ruthenate, $Bi_2Ru_2O_7$ and lead ruthenate, $Pb_2Ru_2O_6$, and particularly preferred is lead ruthenate, $Pb_2Ru_2O_6$.

The electrically conducting component is used in an amount of 10–50% by weight, preferably 12–40% by weight based on the entire weight of the composition containing an organic medium. The amount will be 14–75% by weight, preferably 17–57% by weight on the basis of the total inorganic solids. The term total inorganic solids means the total of conducting components and glass binders. If a composition of this invention contains an inorganic additive, in addition to the electrically conducting components and glass binders, the word total inorganic solids means the total including said inorganic additive.

The thick film resistor composition uses, as a glass binder a mixture of the first glass and the second glass having the compositions as previously defined. The first glass containing at the most 50% by weight of lead oxide, is, in general, a high softening temperature glass, the second glass, which contains a minimum of 50% by weight of lead oxide, is, in general, a low softening point glass. The glass binder of this invention is characterized by using two such glasses which differ in the lead oxide content or the softening temperature.

The first glass and second glass cannot be used individually as glass binders for the thick film resistor composition. The former will not fire and the latter glass is too soft to prevent the shape of the resistor from collapsing. It was unexpected that the use of a mixture of glasses which were considered not possible to be used individually gives a thick film resistor with a small length effect on TCR as well as small variations in the resistance value and the TCR upon firing the coat covering glass.

The first glass is a glass in which the total of $SiO_2$, CaO, $B_2O_3$, PbO and $Al_2O_3$ amounts to at least 95% by weight thereof. At least 30% by weight of $SiO_2$ is needed. This is because a level below this range makes it difficult to provide a sufficiently high softening temperature. However, the amount is not more than 60% by weight. This is because a level greater than this range presents the possibility that $SiO_2$ may crystallize. At least 5% by weight of CaO is needed. However, it should not exceed more than 30% by weight. A level exceeding 30% by weight presents the possibility of the Ca undergoing crystallization with other elements. At least 1% by weight of $B_2O_3$ is needed. However, it should not exceed 40% by weight. A level exceeding 40% by weight presents the possibility that glass formation may not occur. PbO must be no more than 50% by weight. This is because a level exceeding 50% by weight will make it difficult to reach a sufficiently high softening temperature. The preferred level is 0–30% by weight, more particularly 0–20% by weight. $Al_2O_3$ must be in an amount not more than 20% by weight. A level exceeding 20% by weight will prevent glass formation. The preferred amount is 0–5% by weight.

The first glass is used in the amount of 5–35% by weight, preferably 10–25% by weight, based on the weight of the total composition, including the organic medium. The amount is 7–50% by weight, preferably 14–36% by weight if based on the total inorganic solids.

The second glass is a PbO-$SiO_2$ type glass in which PbO amounts to at least 50% by weight. The first glass, only when combined with the second glass, can decrease the length effect of the TCR of a resistor, as well as decrease the variation in the resistance value and the TCR on firing the overcoat glass.

The second glass is preferably a glass containing 50–80% by weight of PbO, 10–35% by weight of $SiO_2$, 0–10% by weight of $Al_2O_3$, 1–10% by weight of $B_2O_3$, 1–10% by weight of CuO and 1–10% by weight of ZnO in which PbO, $SiO_2$, $Al_2O_3$, $B_2O_3$, CuO and ZnO amount to at least 95% by weight. This is because mixing a second glass within the composition of this range with the first glass can further increase the firing capability, in addition to decreasing the length effect on TCR and the small variations in resistance values and the TCR on firing the overcoat glass.

The second glass is used in an amount of 5–40% by weight, preferably 10–35% by weight on the basis of the total weight of the composition containing the organic medium. The amount is 7–57% by weight, preferably 14–50% by weight if based on the total inorganic solids.

The thick film resistor composition of this invention may further comprise a third glass as a glass binder. The third glass is a PbO-$SiO_2$ glass with its softening point adjusted to be lower than that of the first glass but higher than that of the second glass. For example, it has a composition of 65.0% by weight of PbO, 34.0% by weight of $SiO_2$ and 11.0% by weight of $Al_2O_3$.

The third glass is used in an amount of 0–30% by weight, preferably 5–25% by weight on the basis of the total weight of the composition containing he organic medium. The amount is 0–43% by weight, preferably 7–36% by weight if based on the total inorganic solids.

The first, second and third glasses may individually contain, in addition to the above components, less than 5% by weight of a component for controlling the coefficient of thermal expansion of a thick film resistor and the aging temperature of the glass binder. Since the common base material, a 96% alumina ceramic, has a coefficient of thermal expansion of $75\times10^{-7}/C$, the thick film resistor preferably has a lower coefficient of thermal expansion than that. Adjusting the contents of silica, lead oxide and boron oxide can adjust the coefficient of thermal expansion. Sometimes introducing a small amount of lithium, potassium or sodium oxide can adjust the coefficient of thermal expansion. It is advantageous to incorporate up to about 3% by weight of lithium oxide in the glass binder component. Introducing $Li_2O$ into a binder together with a small amount of $ZrO_2$ and/or $TiO_2$ gives preferable effects in addition to that on the coefficient of thermal expansion. Up to about 4% of $ZrO_2$ increases the resistance of a glass against its dissolution in an alkali solution while $TiO_2$ increases the resistance of the glass against acid attack. If the glass is a zinc aluminoborosilicate salt glass containing no PbO, incorporating $Na_2O$ can give a preferred range for the coefficients of thermal expansion.

The first, second and third glasses as glass binders can be prepared by the usual glass manufacturing technology. That is to say, the desired components or their precursors, for example, $H_2BO_3$ for $B_2O_3$ at the desired ratio are mixed and the mixture is heated to give a melted product for manufacture. As is well known in the art to which this invention is related, heating is carried out to reach its peak temperature for a period where the melted product is completely liquid and yet gas evolution ceases. The peak temperature in this invention is 1100–1500 C., normally ranging from 1200–1400 C. The melt is then typically cooled by pouring onto a cold belt or into cold running water for quenching. Then, optionally, the product is mill treated to reduce particle size.

More specifically, the glass used can be prepared by melting in a platinum crucible in an electrically heated silicon carbide furnace for 20 minutes to 1 hour at about 1200–1400 C. A rotary or vibrating mill treatment can bring the final particle size to a level of 1–4 $m^2/g$. The vibrating mill treatment is carried out in an aqueous medium by vibrating a vessel containing the inorganic powder and cylinders, such as alumina and the like for a specific period of time.

The thick film resistor composition of this invention may further contain an inorganic additive such as $Nb_2O_5$. The $Nb_2O_5$ contributes to the electrical conductivity of the thick film resistor. The inorganic additive is used in an amount of 0–4% by weight based on the total weight of the composition including an organic medium or 0–6% by weight if based on the total inorganic solids.

These inorganic solids of this invention are dispersed in an organic medium (vehicle) to prepare a printable base composition. The organic medium is used in an amount of 20–40% by weight, preferably 25–35% by weight on the basis of the total weight of the composition.

Any inert liquid can be used as the vehicle. Water, or a variety of organic liquids can be used as a vehicle either with or without a concentrator and/or stabilizer and/or other general additives. The organic liquids which can be used are, for example, aliphatic alcohols or the esters of such alcohols, such as acetates and propionates, terpenes, such as wood turpentine oil, terpineol and others, resins in solvents such as wood turpentine oil and ethylene glycol monoacetate monobutylether, or such as a solution of polymethyl methacrylate in a lower alcohol or a solution of ethyl cellulose. The vehicle may contain a volatile liquid for accelerating a rapid solidification after applying the vehicle to ba base material, or else the volatile liquid may comprise the vehicle. A preferred vehicle is based on ethyl cellulose and beta-terpineol. The thick resistor composition of this invention can, for example, be prepared by a three-roll mill.

The thick film resistor composition paste was printed to 0.8 mm or 0.5 mm×0.5 mm size. The thickness is chosen to reach a dry film thickness of 18±2 μm. This is then dried for 10 minutes at 150 C. and heated and fired in a belt furnace. The temperature profile of the belt furnace consists of maintaining the sample for 10 minutes at a peak temperature of 850 C. and cooling; the firing time is 30 minutes from the time at which the temperature reaches 100 C. in a heating cycle until the time when the temperature drops below 100 C. in the cooling cycle.

The thick film resistor composition can be prepared by a roll mill.

Resistor Geometries

Figure 3:
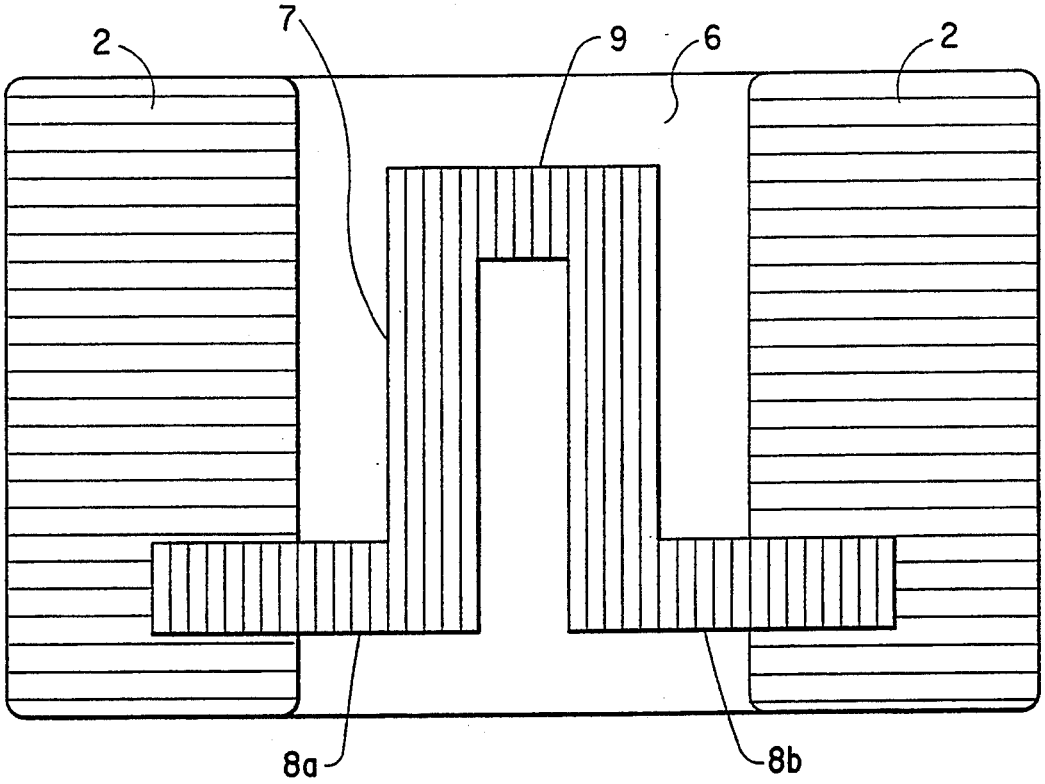
FIGS. 3, 4, 6 and 7 schematically illustrate resistor geometries with respect to terminations on the substrate according to the invention.

Generally, a screen stencil technique can be preferably used The thick film resistor composition is disposed onto an alumina substrate depending upon the forcing of ink through a stencil, screen or mask mounted under tension on a metal frame. As shown in FIGS. 3–6, zigzag or serpentine resistor geometries are produced using stainless steel mesh screens. The patterns corresponding to those geometries are formed photographically on the mesh using ultraviolet sensitive filter emulsion. For example, FIG. 3 schematically illustrates the layout of conductor pads 2, exposed area 6 of the substrate and resistor layer 7 on the surface of substrate, with serpentine resistor geometry as shown in FIG. 3 on a 3.2 mm (L)×2.6 mm (W) chip resistor.

Striplike continuous conductive path 7 as resistor is disposed over the conductor pads 2 and the exposed area 6 of the insulating substrate, which is constituted with two sections 8 and 9 of the conductive path 7 with width of 0.3 mm, one section (8*a*, 8*b*) are to be terminated with respective conductor pad 2 and another section 9 is a part of current flow turn. The turning division 9 of the resistor conductive path 7 is right angled to the connecting sections 8*a* and 8*b* at its connection portions. In the geometry shown in FIG. 3, there are four turns of the current flow through the path 7. The turning section 9 having 0.3 mm width is interlaced by the exposed area 6 of the insulating substrate 6 with the same interposing distance as the width of the path between a pair of the conductor pads 2. (While this is not absolutely essential to the ability of the resistor to function adequately in this patent, it simplifies the screen printing process by allowing both the widest possible conductive path 7 and exposed substrate 6.) The length of the conductive path 7 is about 4 mm, and a large aspect ratio is achieved.

Figure 4:
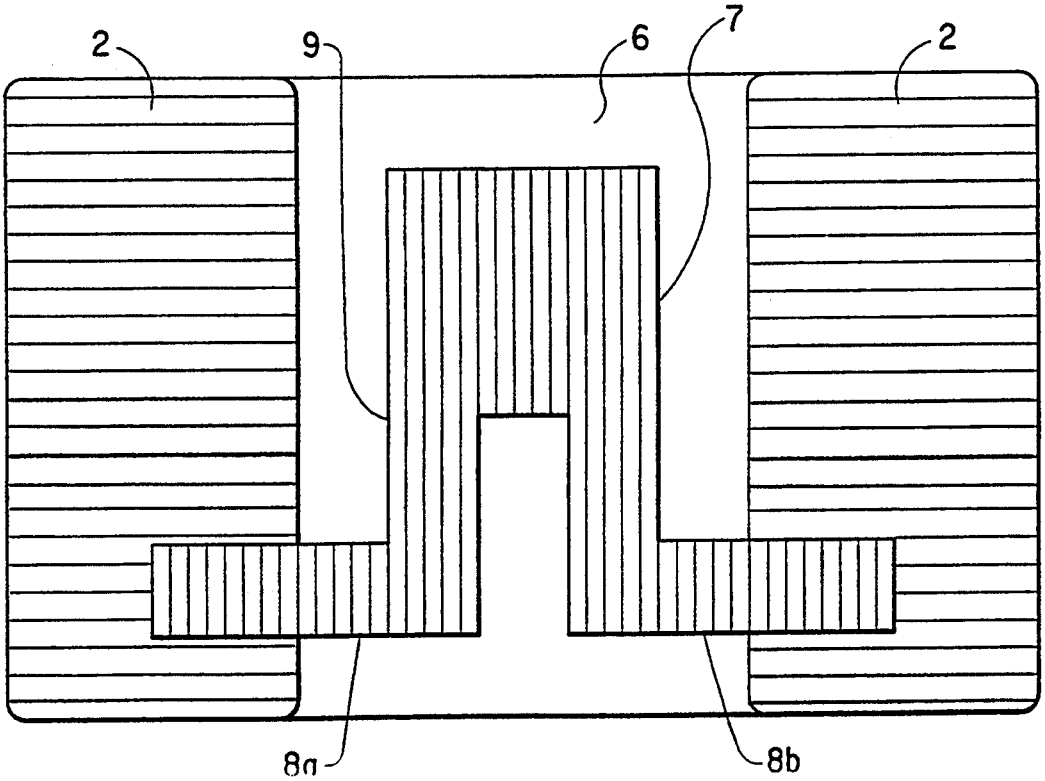

In FIG. 4, the width of the top of the turning section 9 is three times the width of the remaining conductive path 7. The top portion of the turning section 9 of conductive path 7 is laser trimmed to produce stable resistors with predetermined tolerances as shown in FIG. 5.

Figure 5:
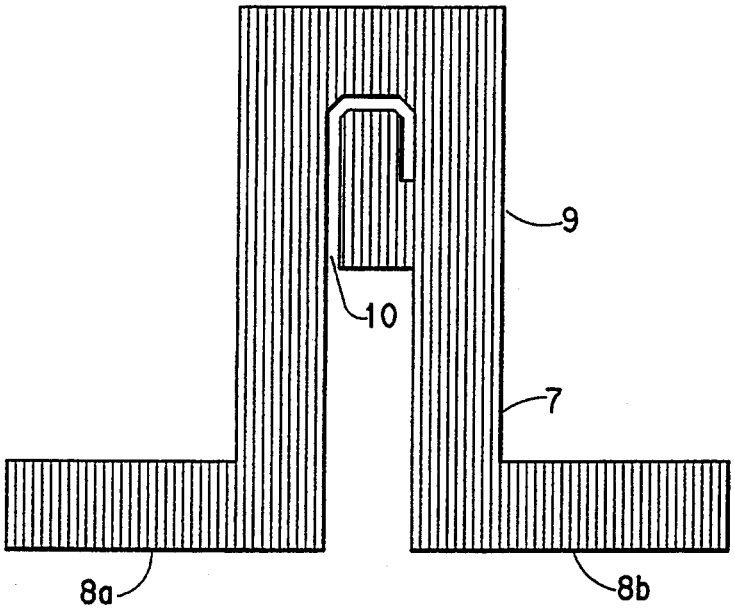
FIG. 5 is a schematic illustration of trim configuration with the resistor geometry in accordance with the present invention.
Figure 6:
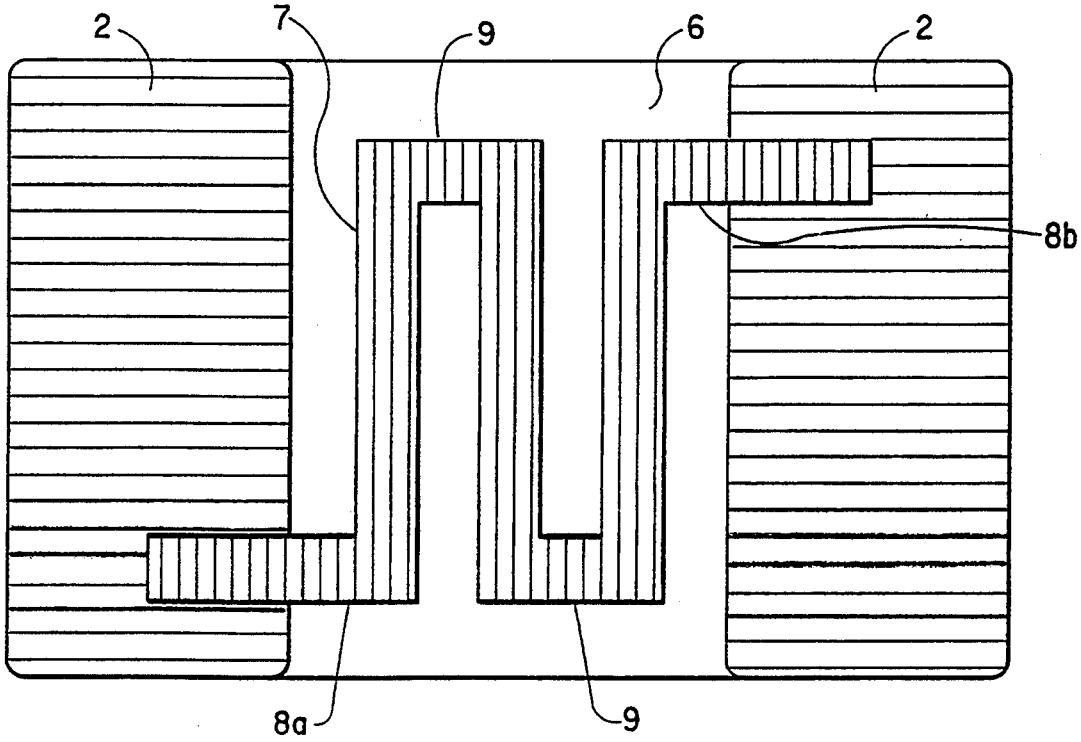
Figure 7:
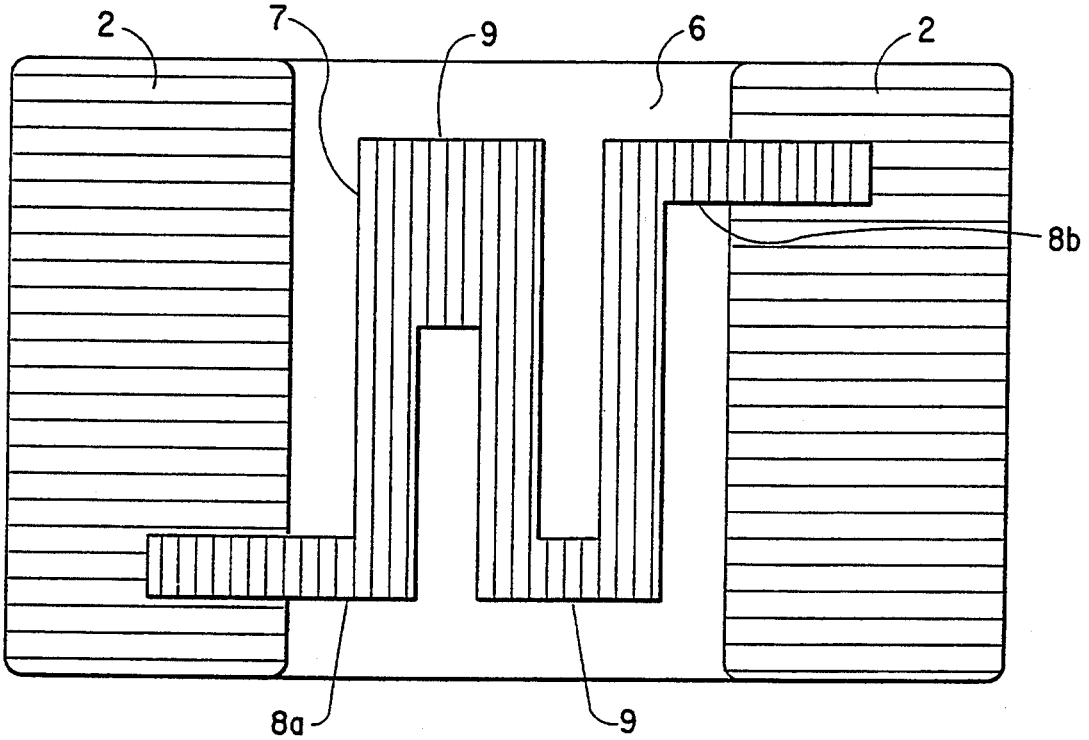

FIG. 6 and 7 illustrate other resistor geometries with a plural turning sections of the conductive resistor path 7, and in addition, with wide top turning section for the purpose of being trimmed in the same way as that in FIG. 5.

Trim Configuration

As shown in FIG. 5, the laser trimming process removes the printed and fired resistor, forming a clean cut or kerf 10. To maintain improved ESD stability, the section divided by the laser cut or kerf must continue to form the strip-like conductive path preceding and subsequent to turning section 9. The cut as shown in FIG. 5 can be called "J cut" because of its configuration.

Test Procedure

The following is a description of the test procedure for measurement of ESD.

ESD at 11.9 Kv is determined by applying a static electrical charge to the thick film resistors for at least one pulse, but typically for multiple pulses. In this invention, the tested resistors are subjected to 5 pulses. The resistors are immersed in dielectric fluid of silicon oil during the test. The percent change of resistance at 25° C. is calculated by comparing the resistance before and after the application of ESD pulses using the equation:

$$ESD\ (\%) = (R_{after\ pulses} - R_{initial})/R_{initial} \times 100$$

For purposes of comparing ESD stability, ESD measurements are made on the untrimmed resistors with non-serpentine resistor geometry and serpentine geometry and on resistors trimmed with both single plunge and "J-type" cuts. The test is conducted in accordance with IC MIL-STD 883 and 1686, Resistor MIL-STD-750 and/or Hybrid DOD-Hdb K263.

Resistance and effect of resistor geometry and trim configuration on ESD of the chip resistor using three different thick film compositions A, B and C with respect to amount of conductive component, such as about 25 wt. %, 20 wt. %, and 15 wt. % based upon the entire weight of the composition are shown in Table 1 below:

TABLE 1

| Thick Film Composition | A | B | C |
|---|---|---|---|
| R Ω | 0.9K | 6k | 50K |
| 1.5 × 1.5 Non-Serpentine | −0.29 | −1.56 | −1.36 |
| Serpentine Un-Trimmed | −0.11 | −0.09 | −0.06 |
| Serpentine Single Plunged | +10.34 | −5.49 | −0.16 |
| Serpentine J-Cut | −0.15 | −0.14 | −0.10 |

We claim:

1. A chip resistor comprising:
(1) an insulating substrate,
(2) a pair of terminations disposed over said substrate,
(3) a resistor layer of thick film composition comprising a mixture of finely divided particles of conductive component and glass binder, and
(4) optionally, a coat covering glass or organic polymeric layer over said resistor layer, wherein said resistor is disposed and patterned on the surface of said substrate by printing and firing said thick film composition to form a continuous conductive resistance path comprising a pair of termination sections each of which contacts one of said terminations and which are insulated from one another by the underlying insulating substrate, and a turn section connecting the termination sections, the turn section comprising at least one segment angled with respect to the longitudinal direction of current flow defined in the respective termination sections whereby the continuous conductive resistance path is considerably longer than a straight line across the insulating substrate lying between said terminations.

2. The resistor of claim 1 wherein the turn section comprises a segment in the longitudinal direction and a segment perpendicular to the longitudinal direction.

3. The resistor of claim 2 of which resistance is adjusted upward by laser trimming one or more said sections using a trimming geometry along the longitudinal direction of said angled section which results in a longer conductive resistance path without reducing the width of the untrimmed section in the perpendicular direction to said longitudinal direction.

* * * * *